US010858156B1

(12) United States Patent
Singh

(10) Patent No.: US 10,858,156 B1
(45) Date of Patent: Dec. 8, 2020

(54) CONTAINER/BOTTLE AND CAP WITH TWO SPOUTS

(71) Applicant: Angad Singh, Potomac, MD (US)

(72) Inventor: Angad Singh, Potomac, MD (US)

( * ) Notice: Subject to any disclaimer, the term of this patent is extended or adjusted under 35 U.S.C. 154(b) by 0 days.

(21) Appl. No.: 16/662,430

(22) Filed: Oct. 24, 2019

(51) Int. Cl.
*B65D 47/06* (2006.01)
*B65D 47/12* (2006.01)

(52) U.S. Cl.
CPC ..... *B65D 47/068* (2013.01); *B65D 47/12* (2013.01); *B65D 2547/066* (2013.01)

(58) Field of Classification Search
CPC . B65D 47/068; B65D 47/12; B65D 2547/066
USPC ..... 222/478
See application file for complete search history.

(56) References Cited

U.S. PATENT DOCUMENTS 1,966,887 A * 7/1934 Dival ..... B65D 47/12 222/541.2
4,207,982 A * 6/1980 Maxwell ..... B65D 47/068 206/459.1
8,777,044 B1 * 7/2014 Raymus ..... A47G 19/2272 220/526
2008/0308558 A1 * 12/2008 Potts ..... B65D 47/12 220/502
2013/0075432 A1 * 3/2013 Staveris ..... A47G 19/12 222/465.1
2015/0225142 A1 * 8/2015 Agassi ..... B65D 47/12 222/153.14
2017/0121077 A1 * 5/2017 Lawson ..... A47G 19/2266
2017/0210523 A1 * 7/2017 Pisarevsky ..... A47G 19/2266
2017/0225855 A1 * 8/2017 Lawson ..... B65D 51/2807
2019/0352059 A1 * 11/2019 Mutch ..... B65D 47/246

* cited by examiner

*Primary Examiner* — Jeremy Carroll

(57) ABSTRACT

The first embodiment of the current invention discloses a container/bottle (1) with a large spout (4) and a small spout (5) for pouring a liquid, powder or granular solid with minimal spilling or dripping. The second embodiment discloses a cap (9) with two spouts, and the third embodiment discloses an insertable spout unit (10) with two spouts.

15 Claims, 4 Drawing Sheets

Container/Bottle and Cap with Spouts

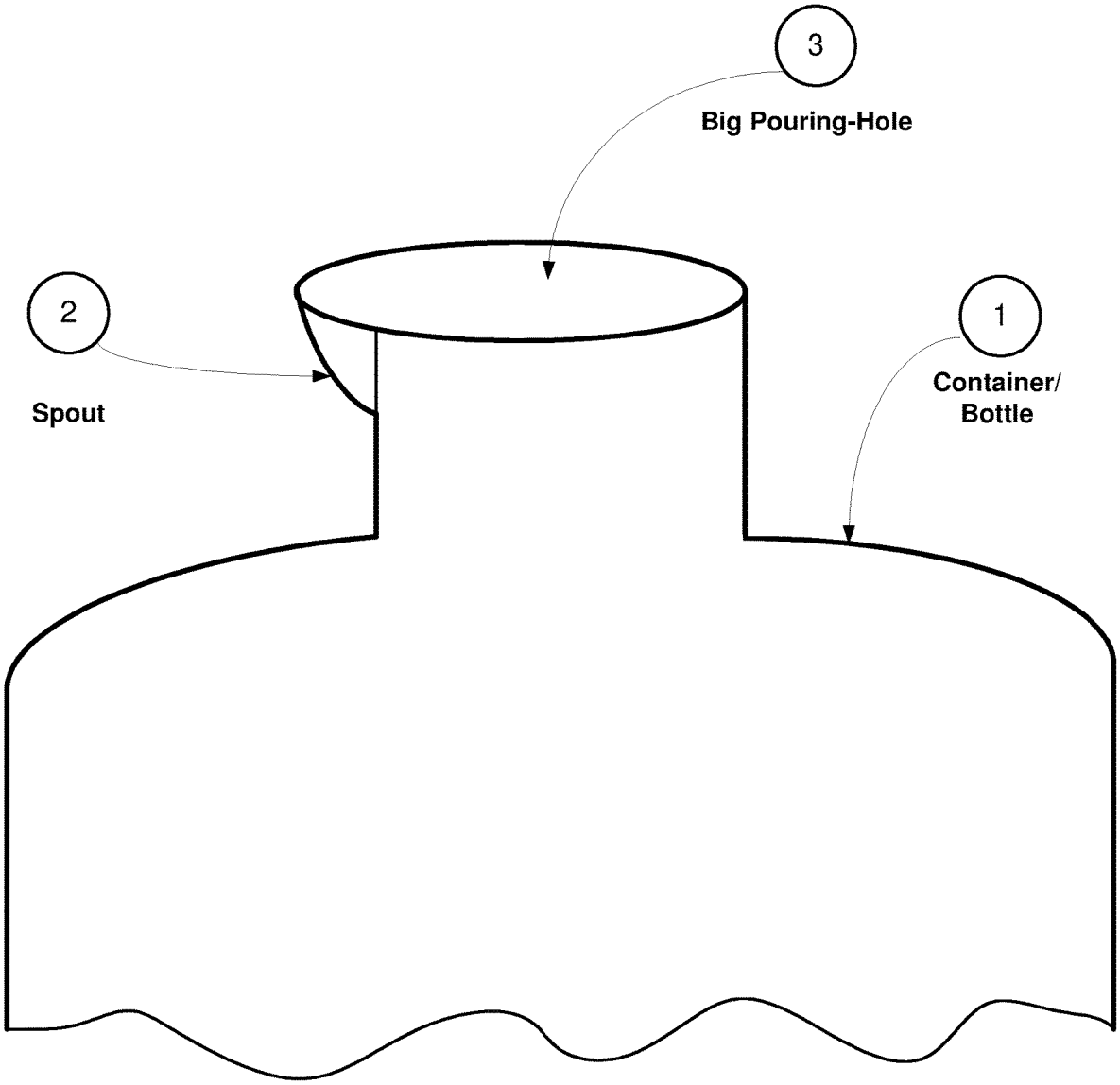
Figure 1. Container/Bottle with Built-In Spout
(Prior Art)

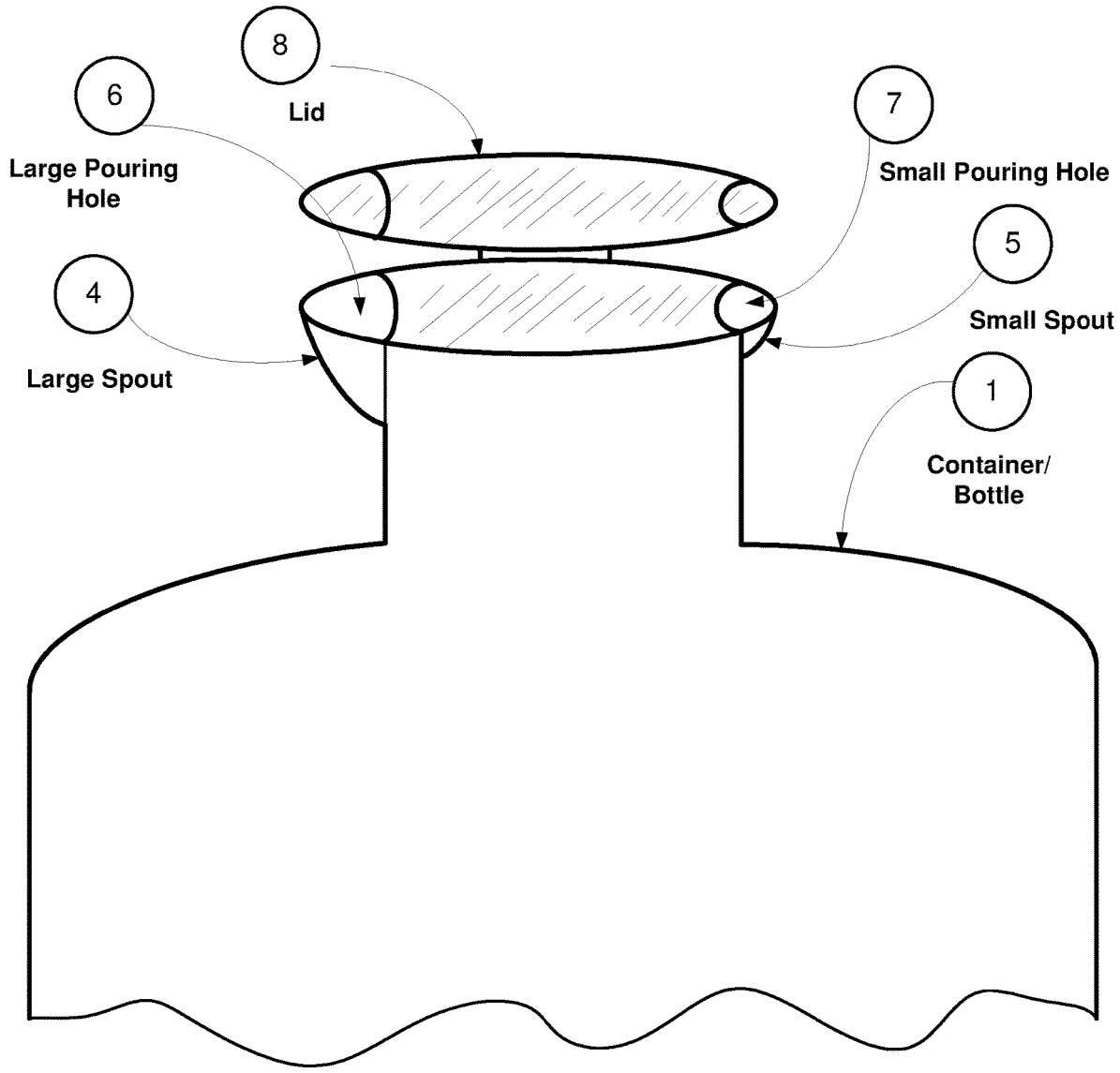
Figure 2. Container/Bottle with Built-In Spouts; and Lid

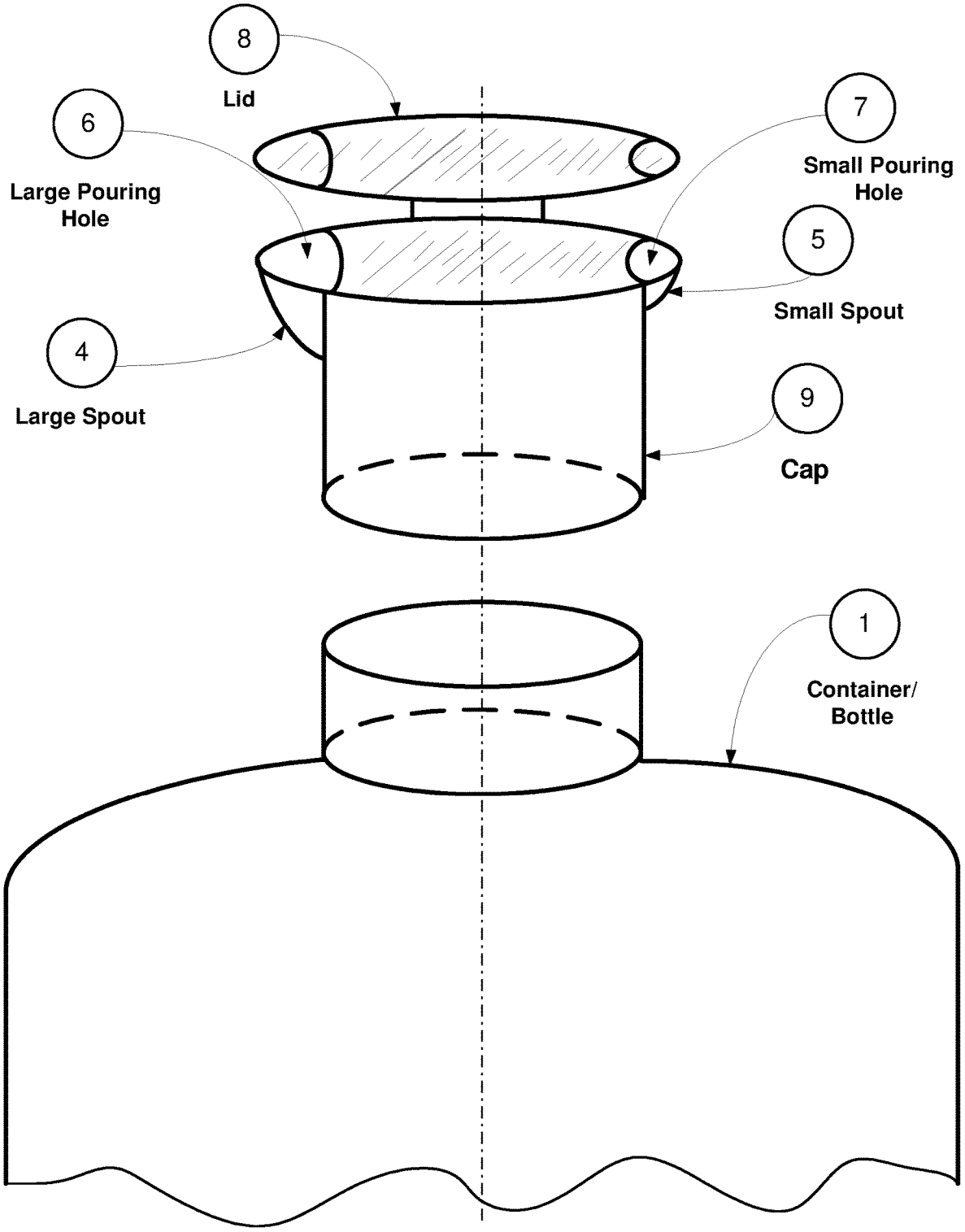
Figure 3. Container/Bottle and Cap with Spouts

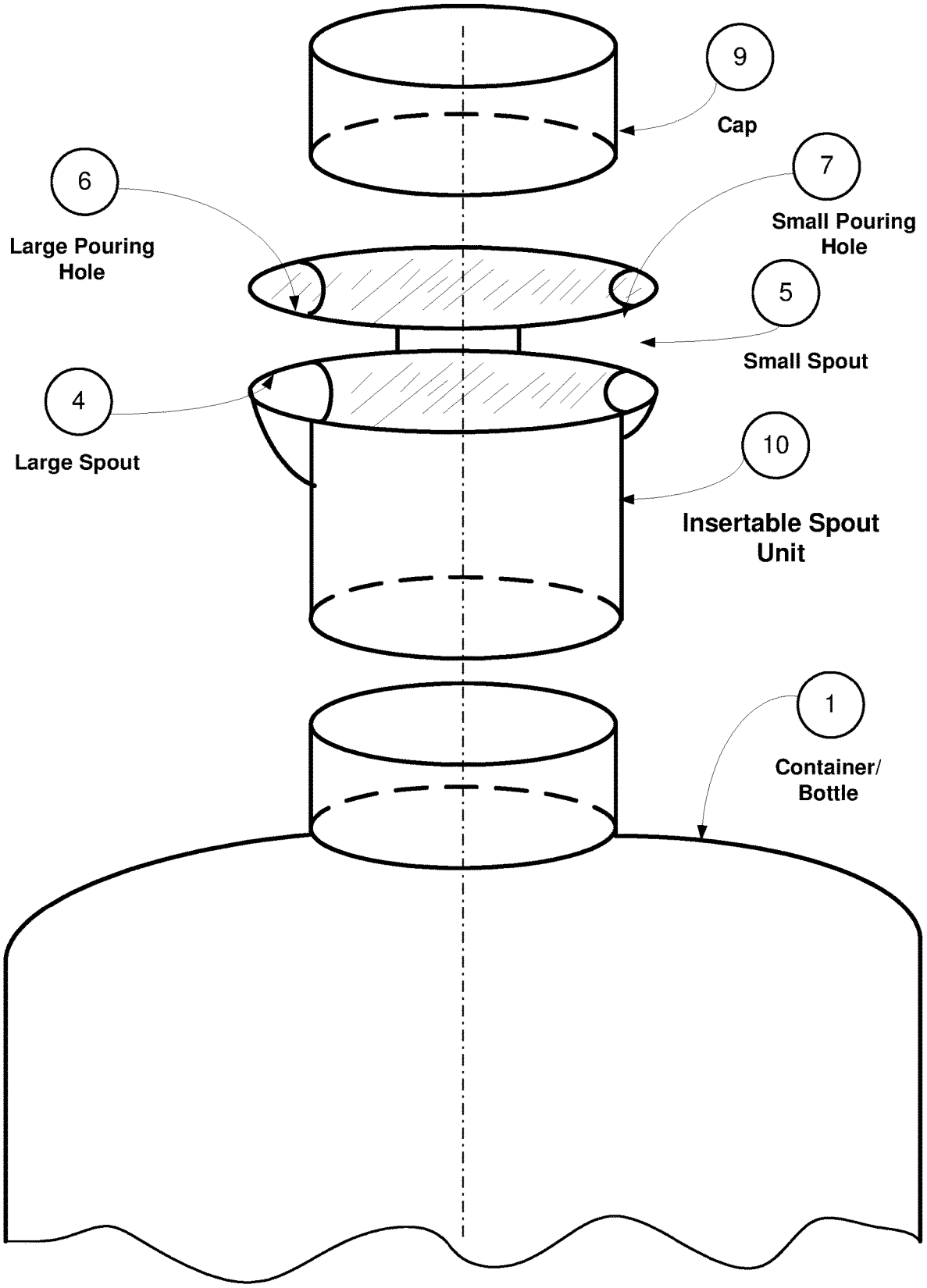
Figure 4. Container/Bottle with "Insertable Spout Unit"

CONTAINER/BOTTLE AND CAP WITH TWO SPOUTS

CROSS REFERENCE TO RELATED APPLICATION

None.

BACKGROUND OF THE INVENTION

Field of Invention

The present invention relates to the field of containers and bottles with caps having spouts for pouring liquids, powders or granular solids.

| RELATED U.S. PAT. | | |
|---|---|---|
| Pat. No. | Issue Date | Patentee |
| U.S. Pat. No. RE46,506 E | Aug. 8, 2017 | James Haley |
| U.S. Pat. No. 10,287,053 B2 | May 14, 2019 | Elaryon Kekeba |
| U.S. Pat. No. 2017,0240323 A1 | Aug. 24, 2017 | Chen et al. |
| U.S. Pat. No. 2008/0210715 A1 | Sep. 4, 2008 | Yoshio Tanaka |
| RELATED U.S. PAT. application publications | | |
| Publication Number | Publication Date | Applicant |
| US 2010/0314349 | Dec. 16, 2010 | Xueban Chen |
| RELATED FOREIGN PAT. DOCUMENTS | | |
| Foreign Doc. No. | Country Code Publication Date | Applicant/Patentee |
| NONE | | |

The containers/bottles are extensively used in daily life for storing liquids such as milk, water, soda, oil and chemicals etc. The prior art till date has disclosed the container/bottle (1) with a spout (2) and a big pouring hole (3) at the top for pouring the liquid. The pouring spouts come in different shapes; an extruding spout (2) at the top of the container/bottle (1) is the most common and extensively used. Such combination comprising a large pouring-hole with extruded-spout does have shortcomings. The pouring of the liquid cannot be controlled because the hole is big. When the container/bottle is nearly full, it is almost impossible to pour small amount of liquid without spilling. Pouring without spilling is more difficult for the larger containers, such as a one gallon milk bottle as compared to 12 oz. bottle. For chemical containers, spilling can become a hazard. Furthermore, pouring small amounts of liquid (for example one spoon of milk, or only a few drops of a chemical) is impossible since the spout and pouring-hole combination is too large.

Due to shortcomings underlined above, most bottles (milk, water, soda, oil etc.) and chemical containers are still being sold without any spout.

BRIEF SUMMARY OF THE INVENTION

The current invention of a container/bottle with two spouts overcomes the underlined shortcomings cited above. Instead of one big pouring hole at the top, the invention discloses two pouring holes. A relatively large hole (6) is associated with a larger spout (4), and the smaller hole (7) with a smaller spout (5). For pouring moderate amount of liquid, the large spout (4) is used, whereas, for pouring small amounts, the smaller spout (5) is used. Under both conditions, the liquid pouring is well controlled since the holes are of appropriate size. Another advantage of the two pouring holes is that the other hole, from which liquid is not poured at a given instance, works as an air inlet hole, which prevents vacuum/negative-pressure build-up inside the container/bottle. This enables well controlled smooth pouring of the liquid. The invention may also be used for pouring powders or granular solids such as sugar.

BRIEF DESCRIPTION OF DRAWINGS

FIG. 1 illustrates an existing (prior art) container/bottle.

FIG. 2 illustrates a container/bottle with built-in pout and lid.

FIG. 3 illustrates a container/bottle and cap with two spouts.

FIG. 4 illustrates a container/bottle with "insertable spout unit".

REFERENCE NUMERALS

| | | |
|---|---|---|
| (1) Container/Bottle (prior art) | (2) Spout (Prior Art) | (3) Big Pouring-Hole (prior art) |
| (4) Large Spout | (5) Small Spout | (6) large Pouring Hole |
| (7) Small Pouring Hole | (8) Lid | (9) Cap |
| (10) Insertable Spout Unit | | |

DETAILED DESCRIPTION OF THE INVENTION

FIG. 1 illustrates a typical prior art spout and a big pouring hole of a container/bottle. The prior art has disclosed other shapes and sizes of the spout for drinking bottles, wine bottles, baby feeding bottle, oil bottles, liquid detergent bottles etc. However, till date the prior art has not disclosed a container/bottle having two spouts as disclosed by the current invention.

FIG. 2, the first embodiment of the invention, illustrates a container/bottle (1) with built-in spouts and the lid (8). Both the large spout (4) and the small spout (5) are integral parts of the container/bottle body. The large pouring hole (6) is used to pour large amount of liquid (based on the large hole size), whereas the small pouring hole (5) is used for pouring small amounts (based on the small hole size) such as a table spoon of milk or oil, or a few drops of chemicals without spilling/dripping. The remaining central portion of the bottle neck at the top is not open. The invention allows smooth controlled flow of the liquid from either hole—one at a time. When the liquid is poured from the large hole (6), the small hole (7) functions as an air-inlet hole. This prevents negative pressure build-up inside the container/bottle, which further aids in the smooth flow of the liquid being poured. And when the liquid is poured from the small hole (7), the large hole (6) works as the air-inlet hole. A lid (8) is connected to the body of the container/bottle, which closes both the holes air-tight in closed position. The lid (8) may be detachably connected to the container/bottle.

FIG. 3, the second embodiment of the invention, illustrates a container/bottle (1), and a cap (9) which has the built-in large spout (4), the small spout (5), the large pouring hole (6), the small pouring hole (7), and the lid (8). The cap (9) keeps the container/bottle hole air-tight with the lid (8) in the closed position. This embodiment provides the same functionality and advantages of embodiment 1.

FIG. 4, the third embodiment of the invention, illustrates the container/bottle (1), the cap (9), and an insertable spout unit (10). The spout unit (10) has built-in large spout (4), the small spout (5), the large pouring hole (6), the small pouring hole (7), and the lid (8). The cap (9) is removed from the container/bottle, and the spout unit (10) is inserted in the container/bottle hole at the top for pouring the liquid. This embodiment provides the same functionality and advantages of embodiment 1.

The shapes of the spouts (4, 5); and sizes of the spouts (4, 5) and holes (6, 7) are not limited to the shapes and sizes shown in FIGS. 1-4. The spouts and holes may have any shape and size that enables smooth controlled flow of the liquid, powder or granular solid being poured.

The invention claimed is:

1. A container/bottle (1) comprising two spouts (4,5) integrated with the body of the container/bottle for pouring liquid, wherein:

the first spout (4) is located on the exterior wall of the neck of the container/bottle, and the second spout (5) is located on the neck's exterior wall opposite to the position of spout (4);

the spouts (4, 5) extrude outwards from the exterior wall of the neck in opposite directions to each other thereby preventing spilling/dripping;

The first spout (4) has a first pouring hole (6), the second spout (5) has a second pouring hole (7), wherein the first pouring hole (6) is larger than the second pouring hole (7);

when liquid is poured from the first spout (4), the air enters the container/bottle (1) through the second pouring hole (7) enabling smooth controlled flow of the liquid, and when liquid is poured from the second spout (5), the air enters the container/bottle (1) through the first pouring hole (6) enabling smooth controlled flow of the liquid.

2. The container/bottle (1) of claim 1 comprising a lid (8) connected to the body of the container/bottle (1) for closing the first (6) and second (7) pouring holes.

3. The container/bottle (1) of claim 1, wherein the lid (8) is detachably connected to the body of the container/bottle (1).

4. The container/bottle (1) of claim 1 is used for pouring powder or granular solids.

5. A detachable cap (9) for the container/bottle (1) comprising two spouts (4, 5) integrated with the body of the cap (9) for pouring liquid, wherein:

the first spout (4) is located on the exterior wall of the cap (9), and the second spout (5) is located on the cap's exterior wall opposite to the position of spout (4);

the spouts (4, 5) extrude outwards from the exterior wall of the cap in opposite directions to each other thereby preventing spilling/dripping;

the first spout (4) has a first pouring hole (6), the second spout (5) has a second pouring hole (7); wherein the first pouring hole (6) is larger than the second pouring hole (7);

while the cap (9) is mounted on the container/bottle (1) and when the liquid is poured through the first spout (4), the air enters the container/bottle (1) through the second pouring hole (7) enabling smooth controlled flow of the liquid, and when the liquid is poured from the second spout (5), the air enters the container/bottle (1) through the first pouring hole (6) enabling smooth controlled flow of the liquid.

6. The cap (9) of claim 5 comprising a lid (8) connected to the body of the cap (9) for closing the first (6) and second (7) pouring holes.

7. The cap (9) of claim 5, wherein the lid (8) is detachably connected to the body of the cap (9).

8. The cap (9) of claim 5 is used for pouring powder or granular solids from the cap spouts (4, 5) while the cap is mounted on the container/bottle (1) and the lid (8) is in the open position.

9. An insertable spout unit (10) for a container/bottle (1) comprising two spouts (4, 5) integrated with the body of the insertable spout unit (10) for pouring liquid, wherein:

the first spout (4) is located on the exterior wall of the insertable spout unit (10), and the second spout (5) is located on the insertable spout unit's exterior wall opposite to the position of spout (4);

the spouts (4, 5) extrude outwards from the exterior wall of the insertable spout unit (10) in opposite directions to each other thereby preventing spilling/dripping;

The first spout (4) has a first pouring hole (6), the second spout (5) has a second pouring hole (7), wherein the first pouring hole (6) is larger than the second pouring hole (7);

while the spout unit (10) is inserted in the container/bottle (1) and when the liquid is poured from the first spout (4), the air enters the container/bottle (1) through the second pouring hole (7) enabling smooth controlled flow of the liquid, and when the liquid is poured from the second spout (5), the air enters the container/bottle (1) through the first pouring hole (6) enabling smooth controlled flow of the liquid.

10. The insertable spout unit (10) of claim 9 comprising a lid (8) connected to the body of the spout unit (10) for closing the first (6) and second (7) pouring holes.

11. The insertable spout unit (10) of claim 9, wherein the lid (8) is detachably connected to the body of the insertable spout unit (10).

12. The spout unit (10) of claim 9 is used for pouring powder or granular solids from the spouts (4, 5) while the spout unit (10) is inserted in the container/bottle (1) and the lid (8) is in the open position.

13. The container/bottle (1) of claim 1 comprises lip shaped spouts (4, 5).

14. The cap (9) of claim 5 comprises lip shaped spouts (4, 5).

15. The spout unit (10) of claim 9 comprises lip shaped spouts (4, 5).

* * * * *